US010833443B2

(12) United States Patent
Morita

(10) Patent No.: US 10,833,443 B2
(45) Date of Patent: Nov. 10, 2020

(54) CONNECTOR

(71) Applicant: KYOCERA CORPORATION, Kyoto (JP)

(72) Inventor: Shunsuke Morita, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/324,085

(22) PCT Filed: Aug. 10, 2017

(86) PCT No.: PCT/JP2017/029147
§ 371 (c)(1),
(2) Date: Feb. 7, 2019

(87) PCT Pub. No.: WO2018/030522
PCT Pub. Date: Feb. 15, 2018

(65) Prior Publication Data

US 2019/0214762 A1 Jul. 11, 2019

(30) Foreign Application Priority Data

Aug. 10, 2016 (JP) ..... 2016-158225

(51) Int. Cl.
*H01R 13/40* (2006.01)
*H01R 12/91* (2011.01)
(Continued)

(52) U.S. Cl.
CPC ..... *H01R 13/40* (2013.01); *H01R 12/721* (2013.01); *H01R 12/91* (2013.01); *H01R 13/631* (2013.01)

(58) Field of Classification Search
CPC ..... H01R 13/40; H01R 12/721; H01R 12/91
(Continued)

(56) References Cited

U.S. PATENT DOCUMENTS 5,259,779 A * 11/1993 Ooya ..... H01R 13/6315 29/856
5,556,286 A * 9/1996 Ikesugi ..... H01R 12/716 439/74
(Continued)

FOREIGN PATENT DOCUMENTS

JP H06-163125 A 6/1994
JP H06-260242 A 9/1994
(Continued)

*Primary Examiner* — Alexander Gilman
(74) *Attorney, Agent, or Firm* — Duane Morris LLP

(57) ABSTRACT

A connector including a plurality of electrically conducting contacts and fitted to another connector, the connector includes: a fixing insulator having a frame shape; a plurality of metal fittings that are disposed at both ends of the fixing insulator in a contact array direction in which the contacts are arrayed, and that are provided inside the fixing insulator; and a movable insulator that is disposed inside the fixing insulator, that is connected to the fixing insulator through elastic deformation portions of the contacts, and that is movable at least in a direction perpendicular to a fitting direction of the fitting with the other connector by elastic deformation of the elastic deformation portions, both ends of the movable insulator in the contact array direction facing the respective metal fittings.

7 Claims, 11 Drawing Sheets

(51) Int. Cl.
*H01R 13/631* (2006.01)
*H01R 12/72* (2011.01)

(58) Field of Classification Search
USPC ..... 439/626
See application file for complete search history.

(56) References Cited

U.S. PATENT DOCUMENTS 7,658,636 B2 * 2/2010 Takeuchi ..... H01R 13/6275 439/357
7,887,350 B2 * 2/2011 Fukazawa ..... H01R 12/707 439/247
8,257,095 B2 * 9/2012 Akai ..... H01R 12/716 439/248
8,480,434 B2 * 7/2013 Funayama ..... H01R 12/716 439/637
9,088,113 B2 7/2015 Funayama et al.
9,178,326 B2 11/2015 Funayama et al.
9,281,594 B2 3/2016 Funayama et al.
9,391,398 B2 * 7/2016 Omodachi ..... H01R 12/707
10,003,146 B2 * 6/2018 Doi ..... H01R 12/707
2003/0115019 A1 * 6/2003 Doddek ..... G05B 23/0235 702/183
2006/0276061 A1 * 12/2006 Koguchi ..... H01R 12/725 439/74
2007/0202729 A1 * 8/2007 Uesaka ..... H01R 12/57 439/248
2009/0239421 A1 * 9/2009 Fukazawa ..... H01R 12/716 439/660
2011/0294326 A1 * 12/2011 Tanaka ..... H01R 12/712 439/248
2014/0213115 A1 * 7/2014 Kimura ..... H01R 24/60 439/629
2015/0044901 A1 * 2/2015 Doi ..... H01R 12/65 439/374
2015/0064935 A1 * 3/2015 Funayama ..... H01R 12/91 439/1

FOREIGN PATENT DOCUMENTS

JP 3007812 U 2/1995
JP H09-320708 A 12/1997
JP H10-312868 A 11/1998
JP H10-326651 A 12/1998
JP 2004-063358 A 2/2004
JP 2004-227911 A 8/2004
JP 2005-050694 A 2/2005
JP 2006216298 A 8/2006
JP 2007220327 A 8/2007
JP 2009-230943 A 10/2009
JP 2009-230945 A 10/2009
JP 2010-055852 A 3/2010
JP 2012-014898 A 1/2012
JP 5422776 B1 11/2013
JP 2014-067706 A 4/2014
JP 2014-146472 A 8/2014
JP 2015-35352 A 2/2015

* cited by examiner

CONNECTOR

CROSS-REFERENCE TO RELATED APPLICATION

This application is a National Stage of PCT international application Ser. No. PCT/JP2017/029147 filed on Aug. 10, 2017, which designates the United States, incorporated herein by reference, and which is based upon and claims the benefit of priority from Japanese Patent Application No. 2016-158225 filed on Aug. 10, 2016, the entire contents of which are incorporated herein by reference.

BACKGROUND

1. Technical Field

The present invention relates to a connector.

2. Description of the Related Art

Connectors connecting different substrates are known. This type of connector is configured such that a first connector attached to one substrate is fitted to a second connector attached to the other substrate. The first connector includes: a fixing insulator fixed to a substrate surface of one substrate; a movable insulator that is disposed to be movable relative to the fixing insulator; and a plurality of contacts that are mounted on the one substrate, that are held by the fixing insulator and the movable insulator, and that are arranged alongside in one direction.

Each of the contacts includes an elastic deformation portion that can be elastically deformed. In the first connector, elastic deformation of the elastic deformation portion allows the movable insulator to move relative to the fixing insulator. This can absorb positional deviation when the second connector is fitted to the first connector and allows positional deviation after the fitting. Part of the movable insulator is disposed between the fixing insulator and the substrate surface. This allows the movable insulator to be fitted to the fixing insulator when the second connector is removed from the first connector, whereby the movement of the movable insulator toward the second connector is restricted.

SUMMARY

Technical Problem

Size reduction has been demanded for the above-described connector, including reduction in the occupied area of the connector mounted on the substrate. For size reduction in the fixing insulator and the movable insulator, there is a limitation on size reduction in a contact array direction in which a plurality of contacts is arrayed because the number of contacts is fixed. In view of the above, size reduction in a width direction orthogonal to the contact array direction is conceivable. However, the size reduction in the width direction causes decrease in strength. For this reason, there is a possibility of the fixing insulator or the like being damaged when, for example, the second connector is removed from the first connector or unintentional force is applied.

For the foregoing reasons, there is a need to prevent decrease in strength while reducing the size of a connector.

Summary

A connector according to an aspect including a plurality of electrically conducting contacts and fitted to another connector, the connector includes: a fixing insulator having a frame shape; a plurality of metal fittings that are disposed at both ends of the fixing insulator in a contact array direction in which the contacts are arrayed, and that are provided inside the fixing insulator; and a movable insulator that is disposed inside the fixing insulator, that is connected to the fixing insulator through elastic deformation portions of the contacts, and that is movable at least in a direction perpendicular to a fitting direction of the fitting with the other connector by elastic deformation of the elastic deformation portions, both ends of the movable insulator in the contact array direction facing the respective metal fittings.

The both ends of the movable insulator in the contact array direction may be formed to be wider than a central part of the movable insulator in a width direction orthogonal to the contact array direction on a plane perpendicular to the fitting direction.

Both ends of the movable insulator in the contact array direction may be restricted by the metal fittings when removed from the other connector.

The fixing insulator may include a fitting surface in the fitting direction, the fitting surface being formed of only the fixing insulator.

The fitting surface may be flat and provided in an identical plane.

The fitting surface may be flat and continuously formed on a whole circumference of the fixing insulator.

A bottom surface of the movable insulator on an opposite side of a surface fitted to the other connector may have a shape in which a distance from a virtual plane facing the bottom surface increases from a center to an end in a direction perpendicular to the fitting direction.

A connector has a movable insulator, both ends in a contact array direction of which face metal fittings. Thus, if the movable insulator is pulled toward another connector when the other connector is removed or unintentional force is applied, the metal fittings restrict the movement of the movable insulator in a fitting direction. As a result, since direct application of force from the movable insulator to the fixing insulator is avoided, damage to the fixing insulator can be prevented during removal or at the time of application of intentional force. The connector is provided in a state where the metal fittings are disposed inside the fixing insulator, i.e., in a state where the metal fittings are not exposed on the surface at the fitting side of the fixing insulator. Accordingly, in comparison with a case where the metal fittings are disposed on the surface of the fixing insulator, damage to other connectors caused by metallic fittings is suppressed, or unevenness of the surface of the fixing insulator is reduced. This allows the other connector to smoothly slide on the surface of the fixing insulator when the other connector is fitted to the connector, thereby making the other connector to be easily inserted into the connector. In this way, the connector may reduce its size, prevent decrease in strength, and improve fitting performance when the other connector is fitted to the connector.

DETAILED DESCRIPTION

With reference to the drawings, embodiments of a connector according to the present invention will be explained below. Embodiments do not limit the present invention. Components in embodiments include the ones that are straightforward and replaceable by a person skilled in the art or substantially identical ones.

Figure 1:
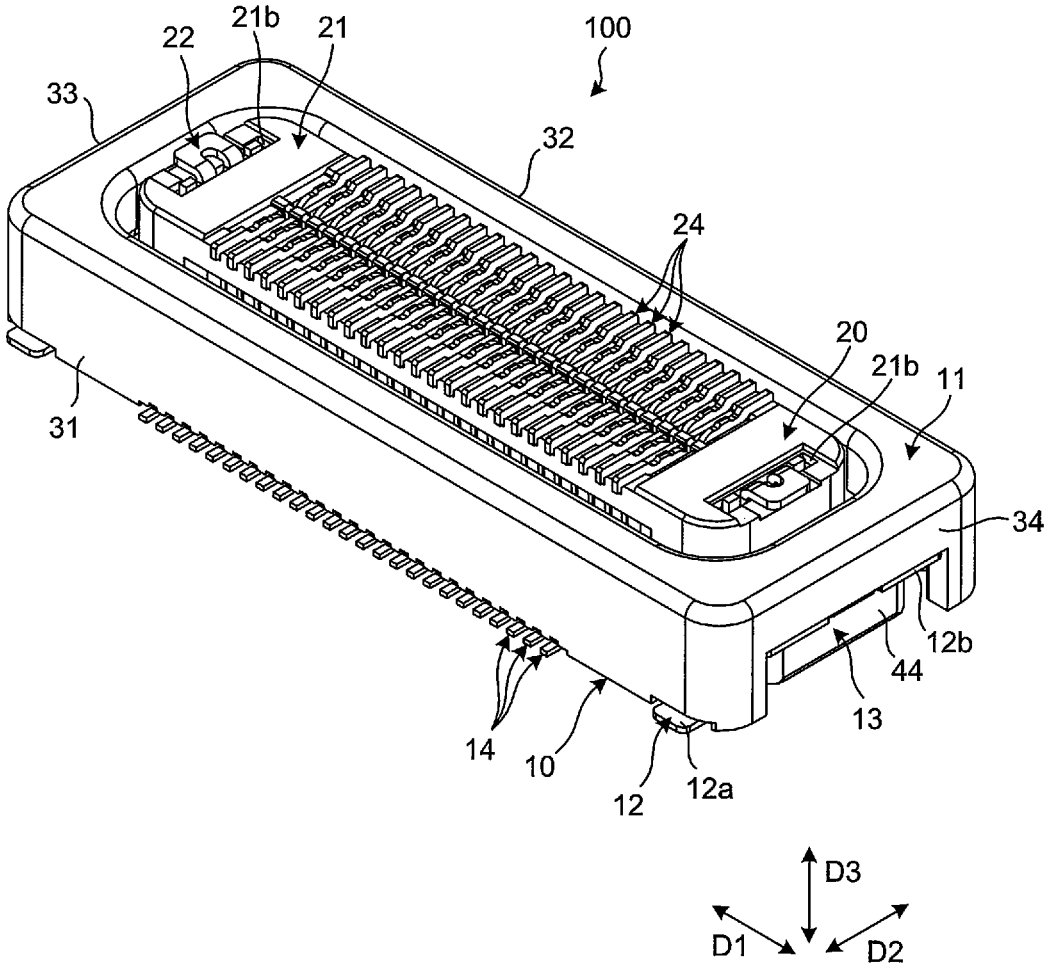
FIG. 1 is a perspective view illustrating an example of a connector according to embodiments.
Figure 2:
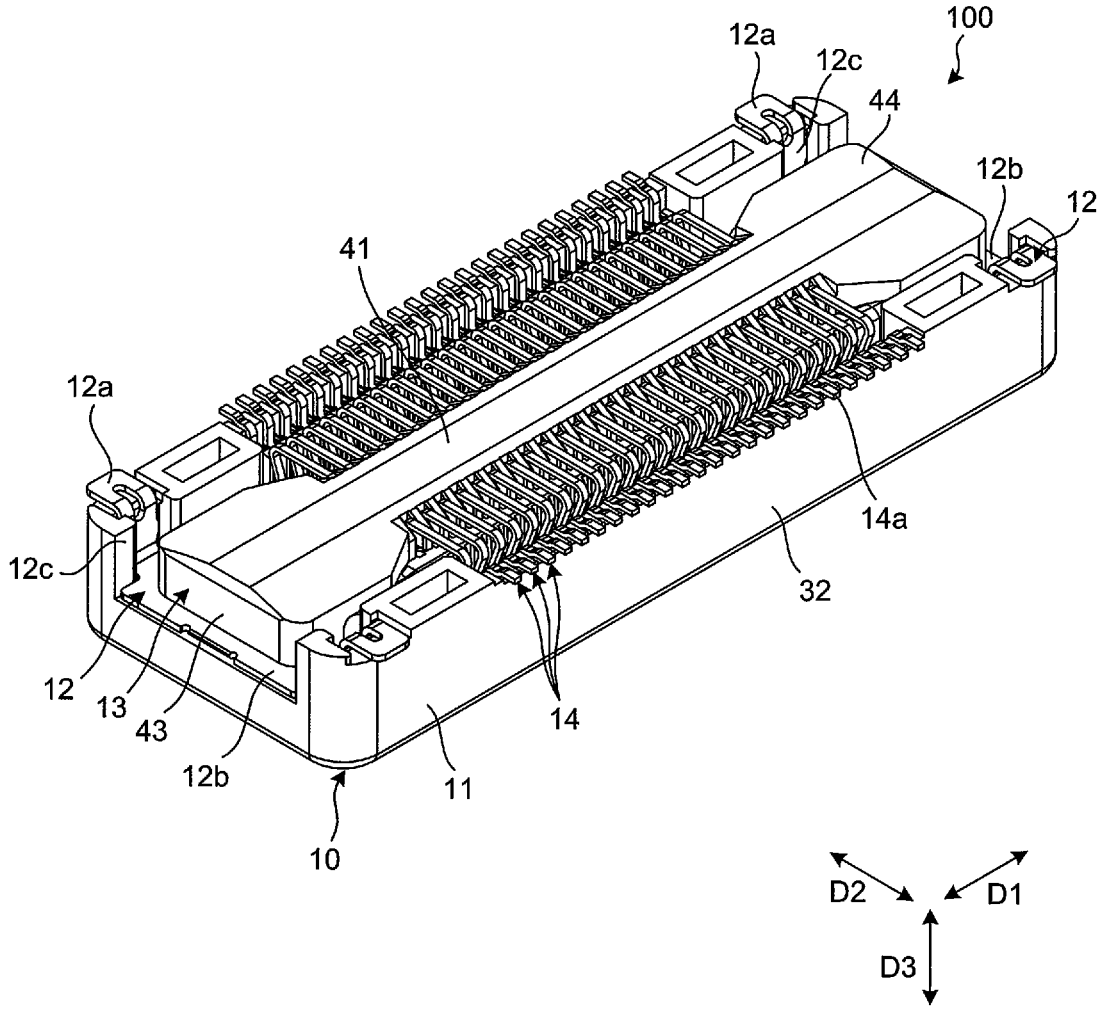
FIG. 2 is a perspective view illustrating an example of the connector according to embodiments.
Figure 3:
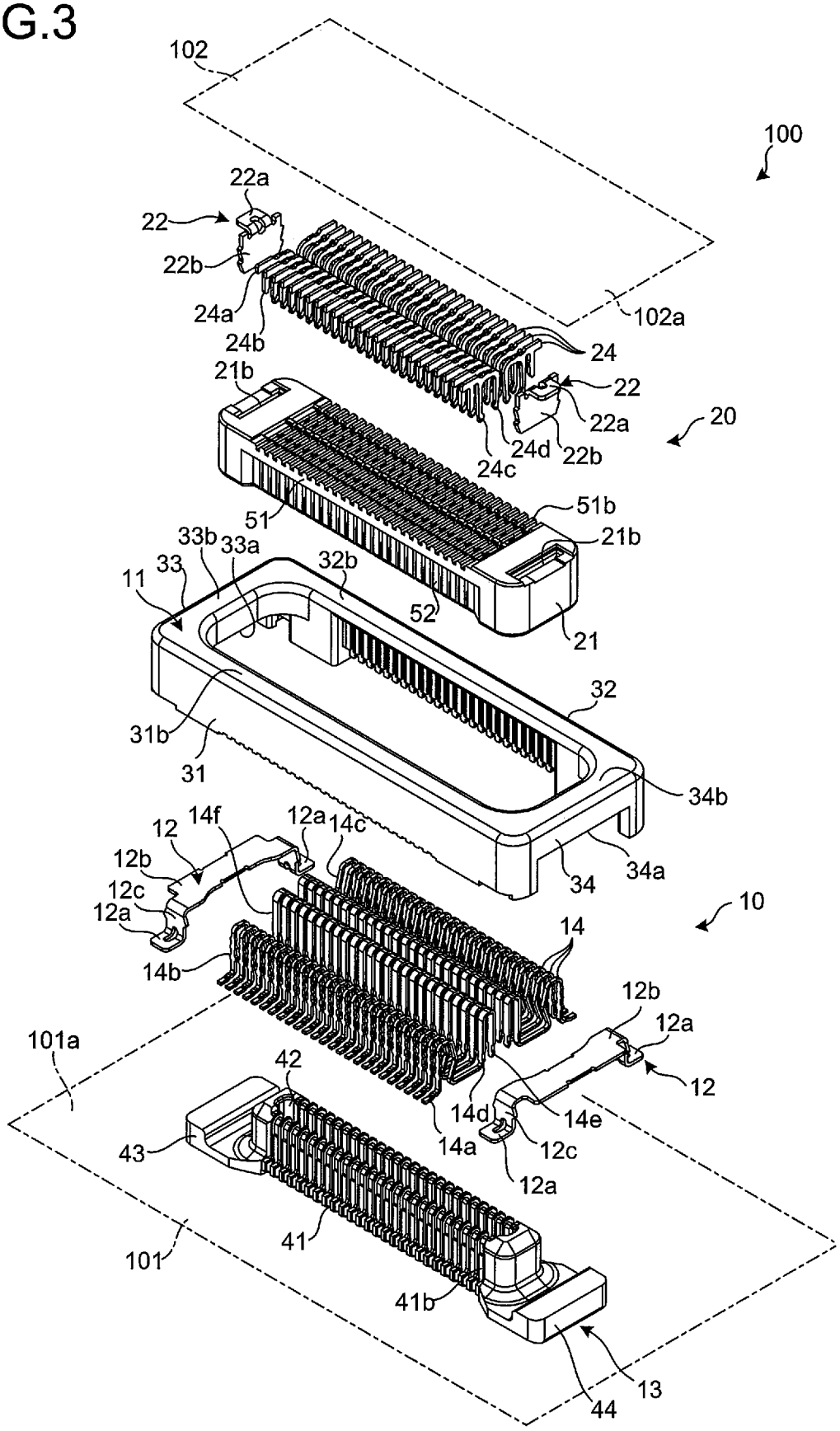
FIG. 3 is an exploded perspective view illustrating an example of the connector according to embodiments.
Figure 4:
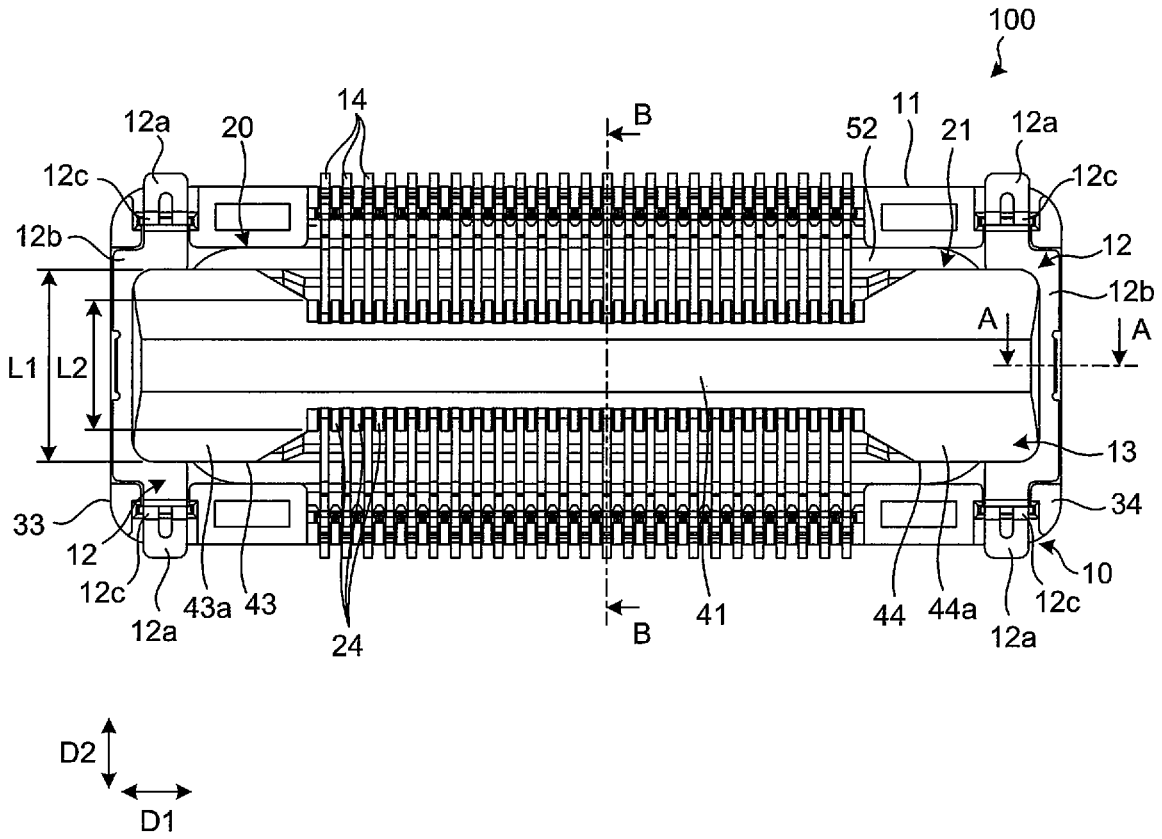
FIG. 4 is a bottom view illustrating an example of the connector according to embodiments.
Figure 5:
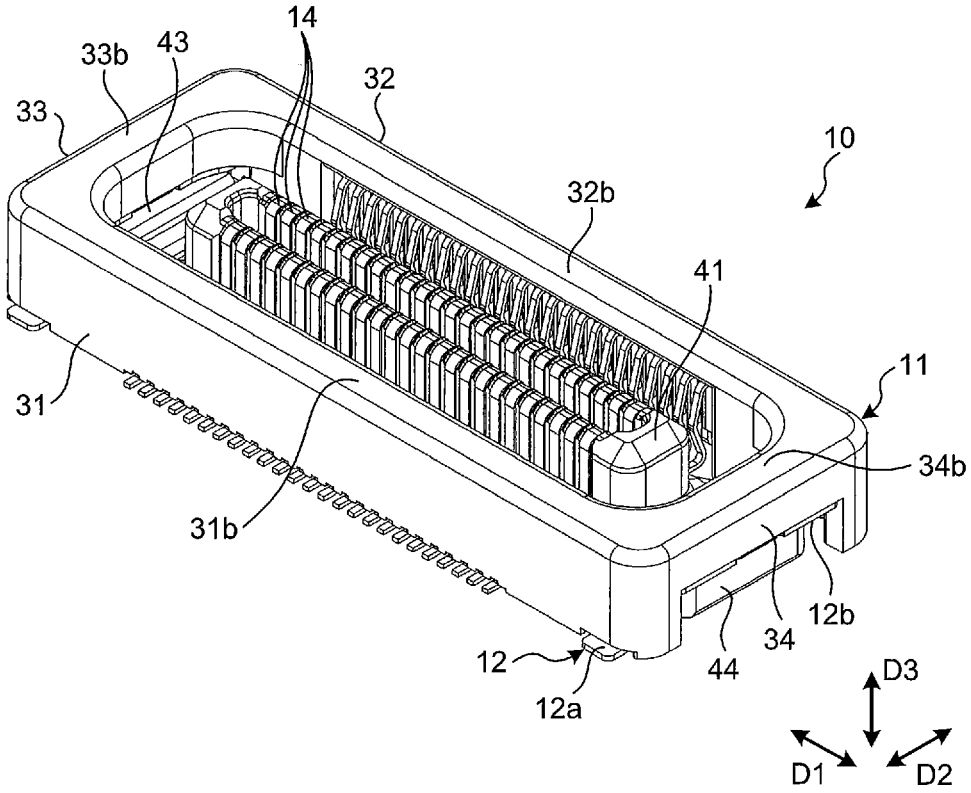
FIG. 5 is a diagram illustrating an example of a first connector according to embodiments.
Figure 6:
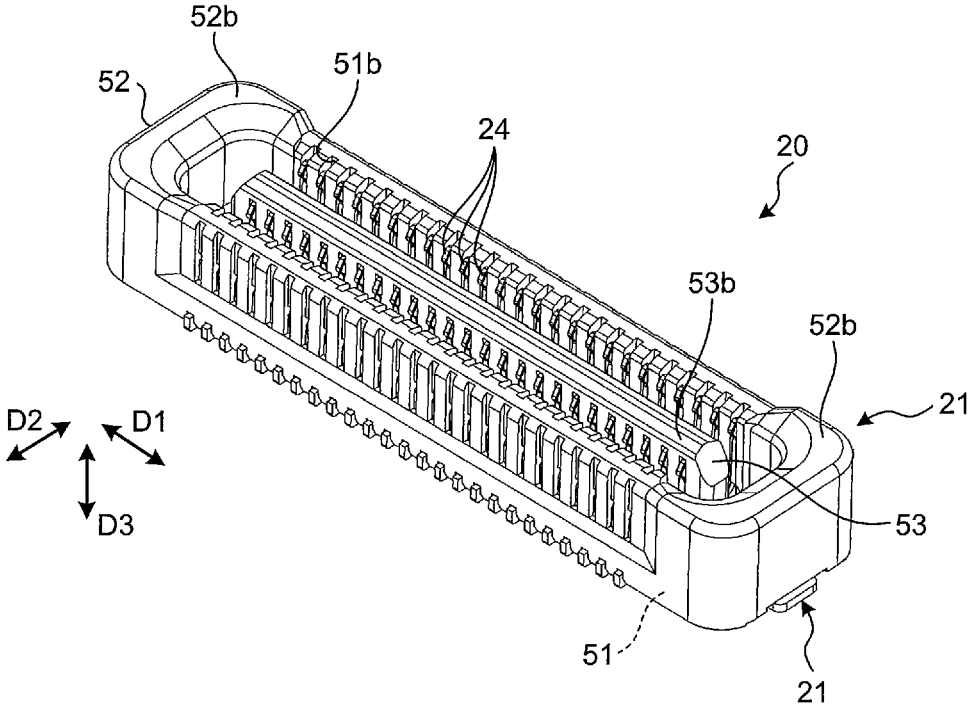
FIG. 6 is a diagram illustrating an example of a second connector according to embodiments.

FIG. 1 and FIG. 2 are perspective views each illustrating an example of a connector 100 according to embodiments. FIG. 3 is an exploded perspective view illustrating a configuration of the connector 100. FIG. 4 is a bottom view illustrating an example of the connector 100 when viewed from a first substrate 101 side. As illustrated in FIG. 1 to FIG. 4, the connector 100 includes a first connector (connector) 10 and a second connector (another/the other connector) 20. FIG. 1, FIG. 2, and FIG. 4 each illustrate a state where the first connector 10 and the second connector 20 are fitted to each other. While embodiments refer to the connector as being configured to include the first connector 10 and the second connector 20, each of the first connector 10 and the second connector 20 is actually configured as a single connector. FIG. 5 is a diagram illustrating an example of the first connector 10. FIG. 5 illustrates the first connector 10 when viewed from a fitting surface side of the first connector 10, the fitting surface being fitted to the second connector 20. FIG. 6 is a diagram illustrating an example of the second connector 20. FIG. 6 illustrates the second connector 20 when viewed from a fitting surface side of the second connector 20, the fitting surface being fitted to the first connector 10.

The first connector 10 is fixed to the first substrate 101. The first connector 10 includes a fixing insulator 11, metal fittings 12, a movable insulator 13, and contacts 14.

The fixing insulator 11 is formed into a rectangular frame shape by using, for example, a resin material. The fixing insulator 11 is disposed with a spacing from a substrate surface 101*a* of the first substrate 101. The fixing insulator 11 includes a wall portion 31 and a wall portion 32, and a beam portion 33 and a beam portion 34. The wall portion 31 and the wall portion 32 are arranged in parallel to a contact array direction D1 of the fixing insulator 11. The contact array direction D1 is a direction in which the contacts 14 are arrayed in the first connector 10. The wall portion 31 is disposed on one side of the fixing insulator 11 in a width direction D2. The wall portion 32 is disposed on the other side of the fixing insulator 11 in the width direction D2. The width direction D2 is a direction orthogonal to the contact array direction D1 on the plane perpendicular to a fitting direction D3 in which the first connector 10 and the second connector 20 are fitted to each other.

The wall portion 31 includes a fitting surface 31*b*. The wall portion 32 includes a fitting surface 32*b*. The fitting surface 31*b* and the fitting surface 32*b* are plain surfaces perpendicular to the fitting direction D3. The fitting surface 31*b* and the fitting surface 32*b* are flat. The fitting surface 31*b* and the fitting surface 32*b* slidably guide the second connector 20 into the inner side of the fixing insulator 11 when the second connector 20 is fitted to the first connector 10.

The beam portion 33 and the beam portion 34 are disposed in parallel to the width direction D2. The beam portion 33 is disposed on one end side of the contact array direction D1. The beam portion 34 is disposed on the other end side of the contact array direction D1. The spacing between the beam portion 33 and the substrate surface 101*a* and the spacing between the beam portion 34 and the substrate surface 101*a* are larger than the spacing between the wall portion 31 and the substrate surface 101*a* and the spacing between the wall portion 32 and the substrate surface 101*a*. The beam portion 33 includes a support surface 33*a* facing the substrate surface 101*a*. The beam portion 34 includes a support surface 34*a* facing the substrate surface 101*a*. The support surface 33*a* and the support surface 34*a* are perpendicular to the fitting direction D3.

The beam portion 33 includes a fitting surface 33*b*. The beam portion 34 includes a fitting surface 34*b*. The fitting surface 33*b* and the fitting surface 34*b* are plain surfaces in parallel to the substrate surface 101*a*. The fitting surface 33*b* and the fitting surface 34*b* are flat. The fitting surface 33*b* and the fitting surface 34*b* are coplanar with the fitting surface 31*b* of the wall portion 31 and the fitting surface 32*b* of the wall portion 32. The fitting surface 33*b* and the fitting surface 34*b*, together with the fitting surface 31*b* and the fitting surface 32*b*, are continuously formed on the whole circumference of the fixing insulator 11. The fitting surface 33*b* and the fitting surface 34*b*, together with the fitting surface 31*b* and the fitting surface 32*b*, slidably guide the second connector 20 into the inner side of the fixing insulator 11 when the second connector 20 is fitted to the first connector 10.

The metal fittings 12 are disposed inside the fixing insulator 11. The metal fittings 12 are locked in a state of being inserted into the fixing insulator 11 in a direction opposite to the direction in which the second connector 20 enters. The metal fittings 12 are provided in a state of being not exposed on the fitting surface 31*b*, the fitting surface 32*b*, the fitting surface 33*b*, and the fitting surface 34*b* of the fixing insulator 11. The metal fittings 12 have a plate-like shape. The metal fittings 12 each include mounting portions 12*a*, an insulator support portion 12*b*, and insulator lock portions 12*c*. One of the mounting portions 12*a* is disposed at one end of the metal fitting 12 and another one of the mounting portions 12*a* at the other end of the metal fitting 12, and the mounting portions 12*a* are bent toward the substrate surface 101*a*. The mounting portions 12*a* are fixed to the substrate surface 101*a*.

The insulator support portion 12*b* is disposed in parallel to the plane orthogonal to the fitting direction D3. The insulator support portion 12*b* is disposed in parallel to the width direction D2. The insulator support portion 12*b* faces or abuts the support surface 33*a* or the support surface 34*a* of the fixing insulator 11. The insulator lock portion 12*c* is locked with the fixing insulator 11. This allows the insulator support portion 12*b* to be positioned immediately beneath the beam portion 33 or the beam portion 34.

Figure 7:
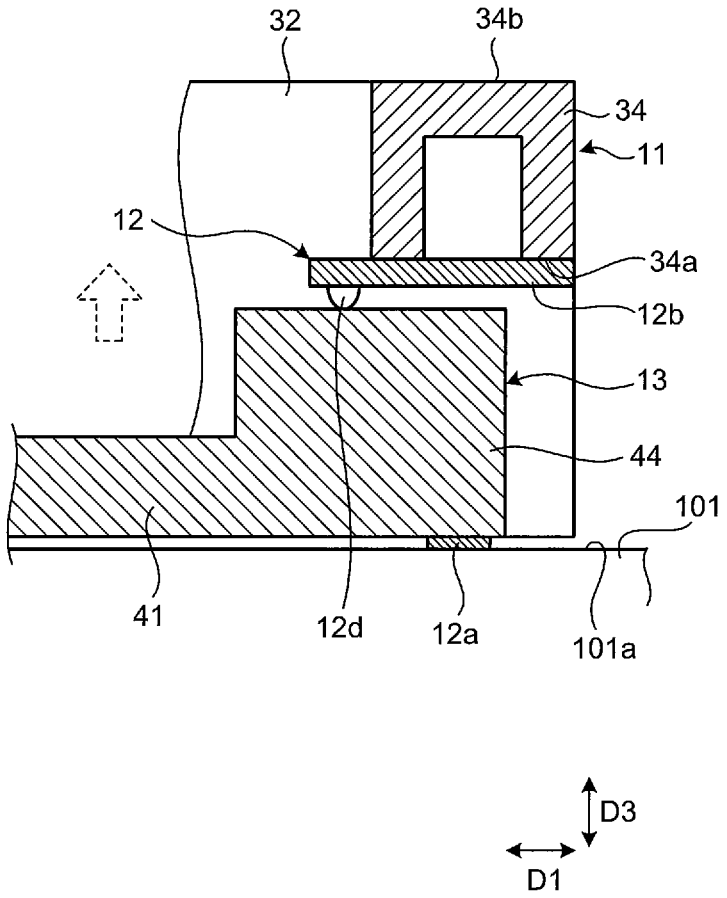
FIG. 7 is a diagram illustrating a configuration taken along A-A of FIG. 4 in cross-section.

FIG. 7 is a diagram illustrating a configuration taken along A-A of FIG. 4 in cross-section. As illustrated in FIG. 7, the insulator support portion 12*b* includes a protrusion portion 12*d*. The protrusion portion 12*d* protrudes from the insulator support portion 12*b* toward the movable insulator 13. The protrusion portion 12*d* is formed in, for example, a semispherical shape. FIG. 7 illustrates the configuration in which the single protrusion portion 12*d* is provided. However, the configuration does not limit embodiments, and may have two or more protrusion portions 12*d*.

The movable insulator 13 is formed by using, for example, a resin material. The movable insulator 13 is provided inside the fixing insulator 11. The movable insulator 13 is disposed with a spacing from the substrate surface 101*a*. The movable insulator 13 includes a contact holding portion 41, an insert hole 42, a lock portion 43, and a lock portion 44.

The contact holding portion 41 extends in parallel to the contact array direction D1. The contact holding portion 41 holds the contacts 14. The contact holding portion 41 includes groove portions 41*b* (see FIG. 3) that hold the contacts 14. The groove portions 41*b*, the number of which corresponds to the number of the contacts 14, are arranged alongside at a predetermined interval in the contact array direction D1.

The contact holding portion 41 is disposed with a spacing in the width direction D2 from the wall portion 31 and the wall portion 32 of the fixing insulator 11. The contact holding portion 41 is disposed with a spacing in the contact array direction D1 from the beam portion 33 and the beam portion 34 of the fixing insulator 11.

Figure 8:
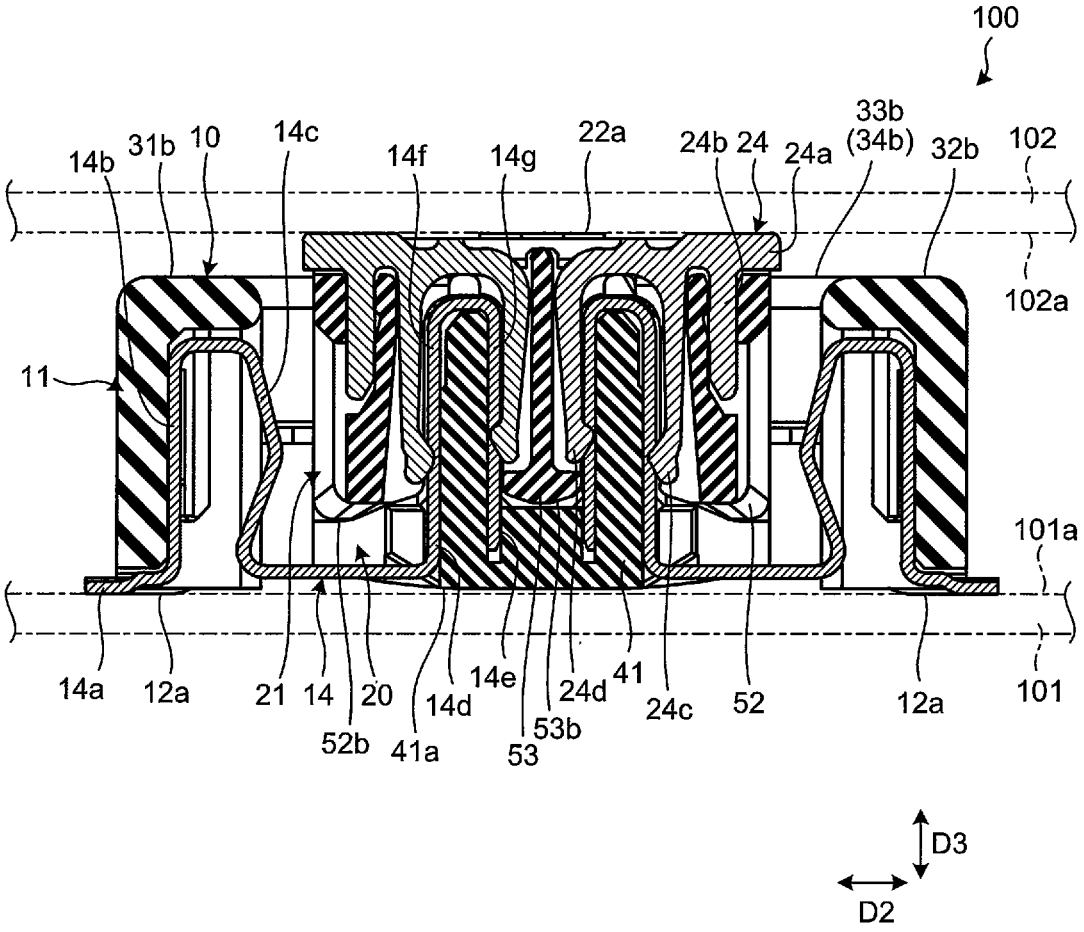
FIG. 8 is a diagram illustrating a configuration taken along B-B of FIG. 4 in cross-section.

FIG. 8 is a diagram illustrating a configuration taken along B-B of FIG. 4 in cross-section. As illustrated in FIG. 8, the contact holding portion 41 includes a bottom surface portion 41*a*. The bottom surface portion 41*a* faces the substrate surface 101*a* of the first substrate 101. The bottom surface portion 41*a* has a shape in which the distance from a virtual plane S increases from the center to both ends in the width direction D2. The virtual plane S is a plane facing the bottom surface portion 41*a*. According to embodiments, for example, the substrate surface 101*a* is the virtual plane S. The bottom surface portion 41*a* may have a curved shape in which it is curved in its entirety in the width direction D2 or, a curved shape in which it is curved only at both ends in the width direction D2. The curved shape of the bottom surface portion 41*a* prevents the contact between the bottom surface portion 41*a* and the substrate surface 101*a* even when the movable insulator 13 sways with an angle relative to the virtual plane S (the substrate surface 101*a*) in the width direction D2. This allows improvement in fitting performance and prevents damage to the first connector 10 during fitting or after fitting when, for example, the second connector 20 is fitted to the first connector 10 in a tilted state with respect to the fitting direction D3.

The insert hole 42 is provided at the center of the contact holding portion 41 when viewed in the fitting direction D3. Part of the second connector 20 is inserted into the insert hole 42.

The lock portion 43 is disposed at one end of the contact holding portion 41 in the contact array direction D1. The lock portion 44 is disposed at the other end of the contact holding portion 41 in the contact array direction D1. The lock portion 43 and the lock portion 44 are each inserted between the insulator support portion 12*b* of the metal fitting 12 and the substrate surface 101*a*. Each of the lock portion 43 and the lock portion 44 is arranged facing the protrusion portion 12*d* of the insulator support portion 12*b*. The arrangement of the lock portion 43 and the lock portion 44 so as to face the protrusion portion 12*d* restricts the movement of the movable insulator 13 in the fitting direction D3. That is, the movable insulator 13 is held so as not to be removed from the fixing insulator 11. Since each of the lock portion 43 and the lock portion 44 is locally in contact with the protrusion portion 12*d*, not the entire insulator support portion 12*b*, sliding resistance is reduced.

A width L1 that is the dimension of the lock portion 43 and the lock portion 44 in the width direction D2 (the dimension in the width direction D2 is hereinafter referred to as a width) is larger than a width L2 of the contact holding portion 41 (see FIG. 4). The width L1 being larger than the width L2 allows the movable insulator 13 to have improved strength of the lock portion 43 and the lock portion 44.

Figure 9:
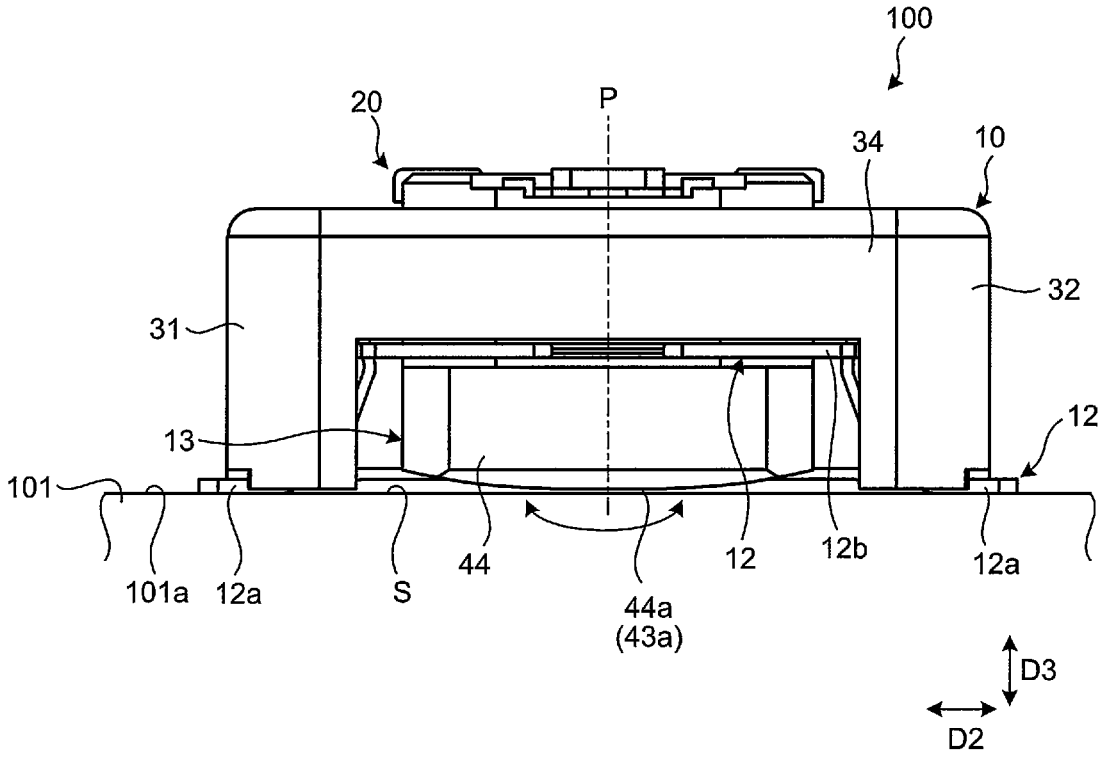
FIG. 9 is a side view illustrating an example of the connector according to embodiments.

FIG. 9 is a side view illustrating an example of the connector 100. FIG. 9 illustrates the connector 100 when viewed from the beam portion 34 side of the first connector 10. As illustrated in FIG. 9, the lock portion 44 includes a bottom surface portion 44*a*. The bottom surface portion 44*a* faces the substrate surface 101*a* of the first substrate 101. The bottom surface portion 44*a* has a shape in which the distance from the virtual plane S increases from the center to both ends in the width direction D2. The virtual plane S is the plane facing the bottom surface portion 44*a*. According to embodiments, for example, the substrate surface 101*a* is the virtual plane S. The bottom surface portion 44*a* may have a curved shape in its entirety in the width direction D2 or a curved shape in which it is curved only at both ends in the width direction D2. The bottom surface portion 44*a* may be coplanar with the bottom surface portion 41*a* of the contact holding portion 41. A bottom surface portion 43*a* (see FIG. 4) of the lock portion 43 has the same configuration as that of the bottom surface portion 44*a* of the lock portion 44. The curved shapes of the bottom surface portion 43*a* and the bottom surface portion 44*a* prevent the contact between the bottom surface portion 43*a* and the bottom surface portion 44*a* and the substrate surface 101*a* even when the movable insulator 13 sways in the width direction D2. The first connector 10 thus allows the movable insulator 13 to sway in the width direction D2.

The contacts 14 are arranged alongside in the contact array direction D1. The contacts 14 are formed by, for example, conducting bending processing on a metallic material. The method for forming the contacts 14 is not limited to the bending processing, and the contacts 14 may be formed by, for example, conducing die-cut processing on a metallic material.

As illustrated in FIG. 8, the contacts 14 each include a mounting portion 14*a*, a first lock portion 14*b*, an elastic deformation portion 14*c*, a second lock portion 14*d*, a third lock portion 14*e*, a first connection portion 14*f*, and a second connection portion 14*g*. The mounting portion 14*a* is mounted on the substrate surface 101*a*. The first lock portion 14*b* is locked with the fixing insulator 11. The elastic deformation portion 14*c* is a portion that is disposed between the first lock portion 14*b* and the second lock portion 14*d*, and that can be elastically deformed. The second lock portion 14*d* and the third lock portion 14*e* are locked with the contact holding portion 41 of the movable insulator 13. The first connection portion 14*f* and the second connection portion 14*g* are in contact with a contact 24 of the second connector 20. The first connection portion 14*f* is disposed closer to the fixing insulator 11. The second connection portion 14*g* is disposed inside the insert hole 42.

The second connector 20 is fixed to a second substrate 102. The second connector 20 includes an insulator 21, metal fittings 22, and the contacts 24.

The insulator 21 is formed in a rectangular shape by using, for example, a resin material. The insulator 21 is disposed with a spacing from a substrate surface 102*a* of the second substrate 102. The insulator 21 includes a contact holding portion 51, an outer insertion portion 52, and an inner insertion portion 53.

The contact holding portion 51 is disposed facing the substrate surface 102*a*. The contact holding portion 51 extends in parallel to the contact array direction D1. The contact holding portion 51 holds the contacts 24. The contact holding portion 51 includes groove portions 51*b* (see FIG. 3) that hold the contacts 24. The groove portions 51*b*, the number of which corresponds to the number of the contacts 24, are arranged alongside at a predetermined interval in the contact array direction D1. The interval between the two adjacent groove portions 51*b* is the same as the interval between the two adjacent groove portions 41*b* of the contact holding portion 41 in the first connector 10.

The outer insertion portion 52 is integrally formed with the contact holding portion 51. The outer insertion portion 52 is formed in a ring shape (see FIG. 6). When the second connector 20 is fitted to the first connector 10, the outer insertion portion 52 is disposed between the wall portion 31, the wall portion 32, the beam portion 33, and the beam portion 34 of the fixing insulator 11 and the contact holding portion 41 of the movable insulator 13. In this case, the outer insertion portion 52 is provided at a position to surround the contact holding portion 41. The outer insertion portion 52 includes a fitting surface 52*b* caused to face the first connector 10 at the time of the fitting (see FIG. 6).

The inner insertion portion 53 is integrally formed with the contact holding portion 51. The inner insertion portion 53 is provided inside the outer insertion portion 52 (see FIG. 6). The inner insertion portion 53 is formed in a plate-like shape. The inner insertion portion 53 is inserted into the insert hole 42 of the movable insulator 13 when the second connector 20 is fitted to the first connector 10. The inner insertion portion 53 includes a fitting surface 53*b* caused to face the first connector 10 at the time of the fitting (see FIG. 6).

The metal fittings 22 have, for example, a plate-like shape. The metal fittings 22 each include a mounting portion 22*a* and an insulator lock portion 22*b*. One of the mounting portions 22*a* is provided at one end of the insulator 21 and another one of the mounting portions 22*a* at the other end of the insulator 21, and the mounting portions 22*a* are arranged in parallel to the substrate surface 102*a*. The mounting portion 22*a* is fixed to the substrate surface 102*a*. The insulator lock portion 22*b* is bent with respect to the mounting portion 22*a* toward the inside of the insulator 21. The insulator lock portion 22*b* is locked with the insulator 21 in a state of being inserted into a metal fitting holding section 21*b* of the insulator 21.

The contacts 24 are arranged alongside in the contact array direction D1. The contact 24 is formed by, for example, conducting die-cut processing on a metallic material. The method for forming the contacts 24 is not limited to the die-cut processing, and the contacts 24 may be formed by conducting, for example, bending processing on a metallic material.

The contacts 24 each include a mounting portion 24*a*, a lock portion 24*b*, a first connection portion 24*c*, and a second connection portion 24*d*. The mounting portion 24*a* is mounted on the substrate surface 102*a*. The lock portion 24*b* is locked with the contact holding portion 51 of the insulator 21. The first connection portion 24*c* is disposed on the inner periphery of the outer insertion portion 52. The first connection portion 24*c* is connected to the first connection portion 14*f* of the contact 14 provided in the first connector 10. The second connection portion 24*d* is disposed on the outer periphery of the inner insertion portion 53. The second connection portion 24*d* is connected to the second connection portion 14*g* of the contact 14 provided in the first connector 10.

Figure 10:
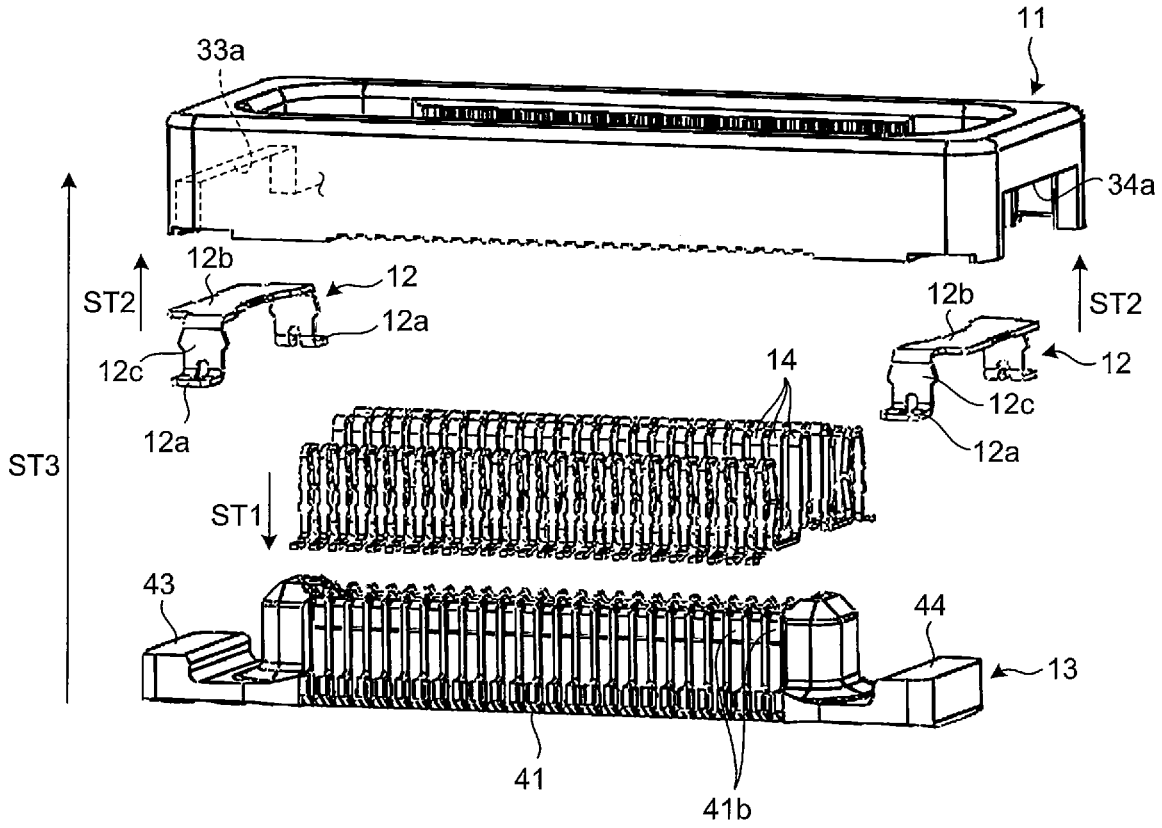
FIG. 10 is a diagram illustrating the flow of assembling the first connector according to embodiments.

The following describes the steps for assembling the first connector 10 and the second connector 20. FIG. 10 is a diagram illustrating the flow of assembling the first connector 10. A first assembly step (ST1 in FIG. 10) will be explained. At the first assembly step, the contacts 14 are inserted into the groove portions 41*b* of the movable insulator 13 from above. This step allows the contacts 14 to be locked and held by the movable insulator 13.

A second assembly step (ST2 in FIG. 10) will be explained. At the second assembly step, the metal fittings 12 are inserted into the fixing insulator 11 from beneath. The insulator support portions 12*b* abut the support surface 33*a* and the support surface 34*a* of the fixing insulator 11. The step allows the insulator lock portions 12*c* to be locked with the fixing insulator 11. Thus, the metal fittings 12 are locked with the fixing insulator 11 in a state of being disposed inside the fixing insulator 11, i.e., in a state of being not exposed on the surface at the fitting side of the fixing insulator 11. Either one of the first assembly step and the second assembly step may be performed first.

A third assembly step (ST3 in FIG. 10) will be explained. At the third assembly step, the movable insulator 13 holding the contacts 14 is inserted into the fixing insulator 11, with which the metal fittings 12 are locked, from beneath. This step allows the movable insulator 13 to be disposed inside the fixing insulator 11 in a state where the lock portion 43 and the lock portion 44 of the movable insulator 13 face or abut the respective metal fittings 12. Assembling of the first connector 10 is thus completed.

Figure 11:
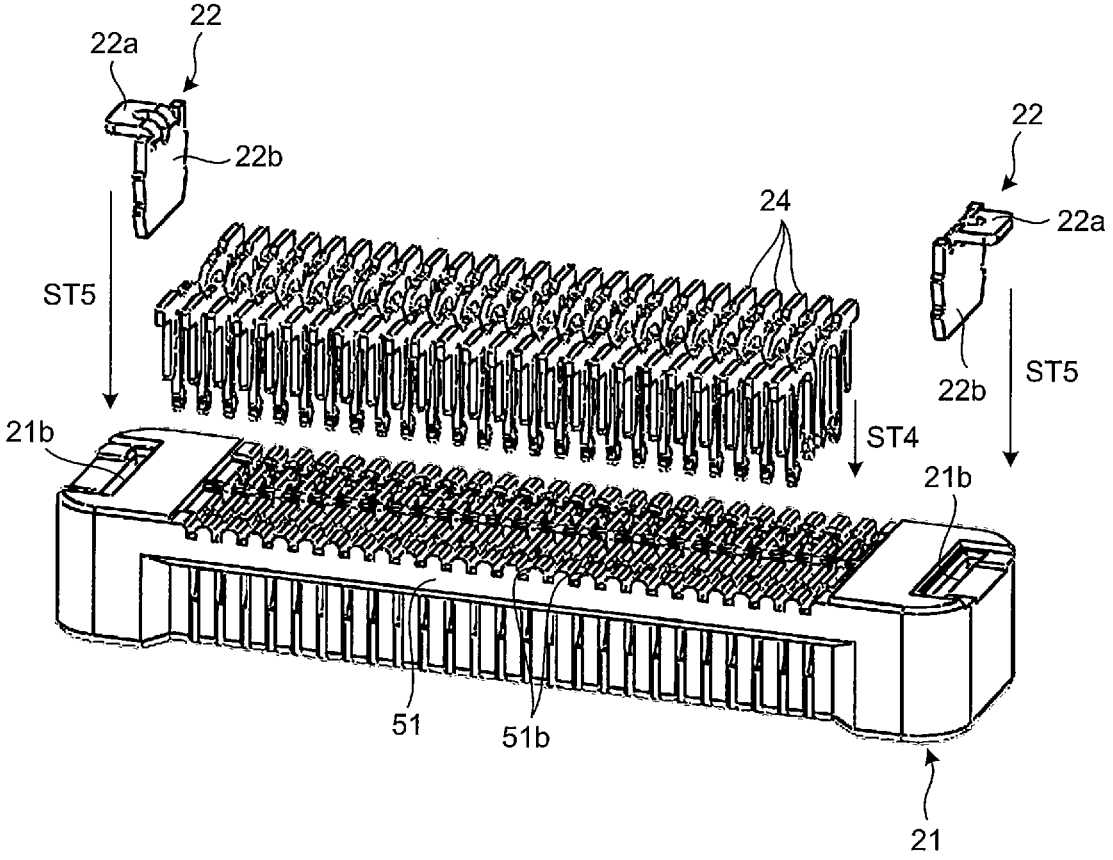
FIG. 11 is a diagram illustrating the flow of assembling the second connector according to embodiments.

FIG. 11 is a diagram illustrating the flow of assembling the second connector 20. A fourth assembly step (ST4 in FIG. 11) will be explained. At the fourth assembly step, the contacts 24 are inserted into the groove portions 51*b* of the insulator 21 from above. The step allows the contacts 24 to be locked and held by the insulator 21.

A fifth assembly step (ST5 in FIG. 11) will be explained. At the fifth assembly step, the metal fittings 22 are inserted into the respective metal fitting holding sections 21*b* of the insulator 21 from above. The insulator lock portions 22*b* are locked with the insulator 21 inside the respective metal fitting holding sections 21*b*. Assembling of the second connector 20 is thus completed. Either one of the fourth assembly step and the fifth assembly step may be conducted first.

Figure 12:
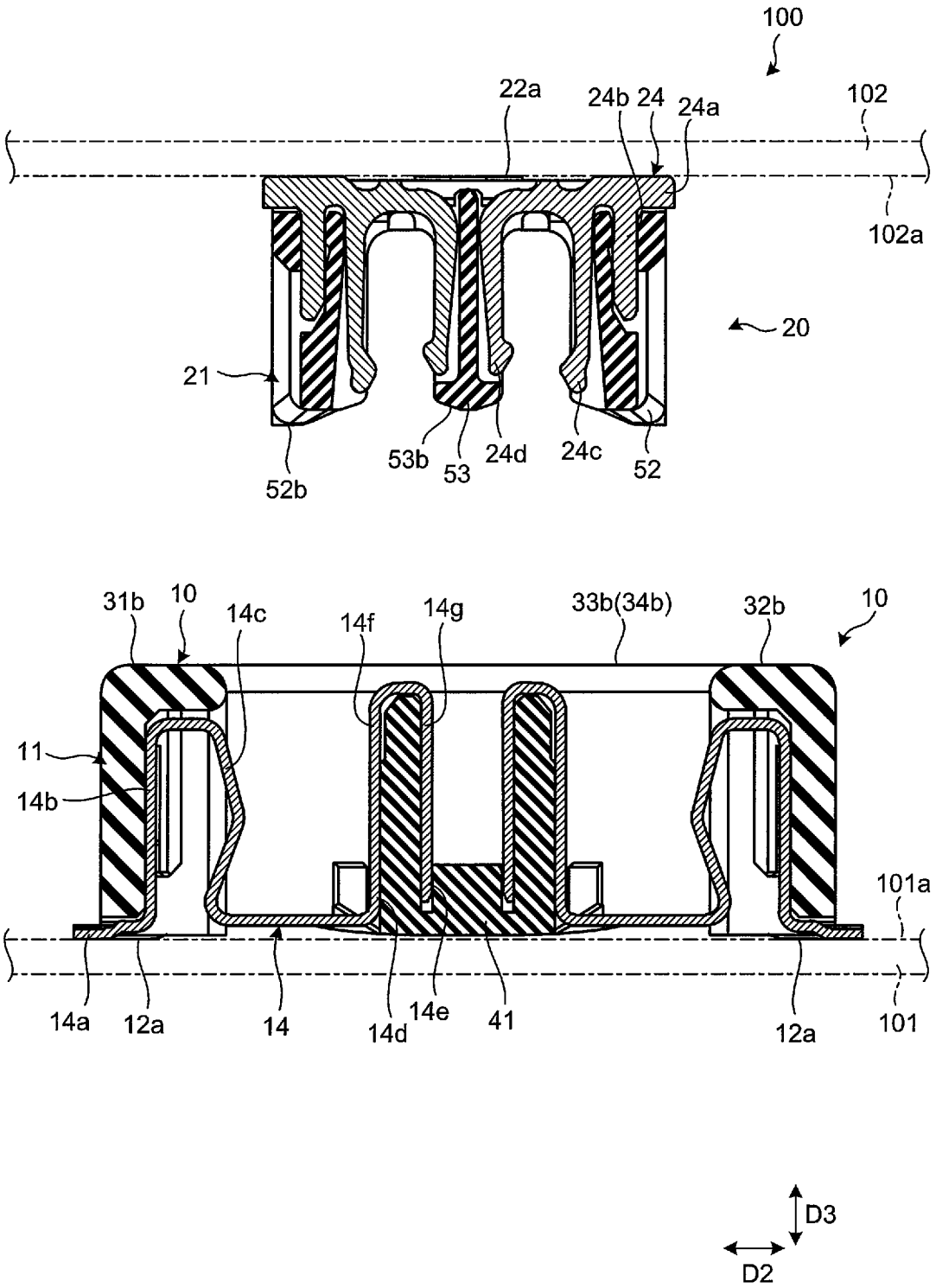
FIG. 12 is a diagram illustrating a state where the first connector faces the second connector according to embodiments.

FIG. 12 is a diagram illustrating a state where the first connector 10 faces the second connector 20. When the first connector 10 and the second connector 20 are fitted to each other, as illustrated in FIG. 12, the fitting surface 31*b*, the fitting surface 32*b*, the fitting surface 33*b*, and the fitting surface 34*b* of the first connector 10 face the fitting surface 52*b* and the fitting surface 53*b* of the second connector 20. In this state, the first connector 10 and the second connector 20 are moved relative to each other to adjust positions.

At the time of the positional adjustment, for example, the fixing insulator 11 of the first connector 10 and the insulator 21 of the second connector 20 are brought into contact with each other, and caused to slide in a direction perpendicular to the fitting direction D3. In the first connector 10, the fitting surface 31*b*, the fitting surface 32*b*, the fitting surface 33*b*, and the fitting surface 34*b* of the fixing insulator 11 are flat. Consequently, the second connector 20 smoothly moves on the fitting surface 31*b*, the fitting surface 32*b*, the fitting surface 33*b*, and the fitting surface 34*b*.

The positional adjustment allows the outer insertion portion 52 of the insulator 21 to be inserted between the fixing insulator 11 and the contact holding portion 41 of the first connector 10, and allows the inner insertion portion 53 to be inserted into the insert hole 42. This allows fitting among the fixing insulator 11, the movable insulator 13, and the insulator 21. The fitting brings the first connection portion 24*c* of the contact 24 in contact with the first connection portion 14*f* of the contact 14. The fitting also brings the second connection portion 24*d* of the contact 24 in contact with the second connection portion 14*g* of the contact 14. Consequently, the contacts 14 are electrically connected to the contacts 24.

If relative force is applied between the first substrate 101 and the second substrate 102 in the width direction D2 when or after the outer insertion portion 52 and the inner insertion portion 53 are inserted, the movable insulator 13 sways in the width direction D2. Accordingly, when the fixing insulator 11 and the movable insulator 13 of the first connector 10 are fitted to the insulator 21 of the second connector 20 in a state of being shifted in the width direction D2, for example, the positional relation between the first connector 10 and the second connector 20 is easily corrected by the movable insulator 13 swaying in the width direction D2. Since the bottom surface portion 41*a*, the bottom surface portion 43*a*, and the bottom surface portion 44*a* are curved, the bottom surface portion 41*a*, the bottom surface portion 43*a*, and the bottom surface portion 44*a* are prevented from being in contact with the substrate surface 101*a* even when the movable insulator 13 sways in the width direction D2.

When the second connector 20 is removed from the first connector 10, force is applied to the first substrate 101 and the second substrate 102 in a direction to separate from each other. This force pulls the contact holding portion 41 toward the second connector 20, and the lock portion 43 and the lock portion 44 press the respective insulator support portions 12*b* of the respective metal fittings 12 toward the second connector 20. Accordingly, the metal fittings 12 restrict the movement of the movable insulator 13 toward the second connector 20.

At this time, force directed to the second connector 20 side is applied to the lock portion 43 and the lock portion 44. As the lock portion 43 and the lock portion 44 have the width L1 that is larger than the width L2 of the contact holding portion 41 and have improved strength, they are held by the respective insulator support portions 12*b* of the respective metal fittings 12 without any damage or the like. As the metal fittings 12 are made of metal and fixed to the substrate surface 101*a* of the first substrate 101 with the mounting portions 12*a*, they are not deformed or separated from the substrate surface 101*a*, whereby the movement of the movable insulator 13 toward the second connector 20 is reliably restricted. Since direct application of force from the lock portion 43 and the lock portion 44 to the fixing insulator 11 is avoided, damage or the like to the fixing insulator 11 is prevented.

Accordingly, without any damage or the like to the fixing insulator 11 and the movable insulator 13, the outer insertion portion 52 of the insulator 21 is pulled out from between the fixing insulator 11 and the contact holding portion 41, and the inner insertion portion 53 is pulled out from the insert hole 42. Thus, the first connection portion 24*c* and the first connection portion 14*f* are separated from each other, and the second connection portion 24*d* and the second connection portion 14*g* are separated from each other. As a result, the contact 14 and the contact 24 are electrically disconnected.

As described above, in the connector 100 according to embodiments, the lock portion 43 is disposed at one end of the movable insulator 13 in the contact array direction D1 and the lock portion 44 at the other end of the movable insulator 13 in the contact array direction D1 such that the lock portions 43 and 44 face the respective metal fittings 12. Accordingly, if the movable insulator 13 is pulled toward the second connector 20 when the second connector 20 is removed from the first connector 10 or when unintentional force is applied, the metal fittings 12 restrict the movement of the movable insulator 13 in the fitting direction D3 (in the direction to remove the second connector 20). This prevents direct application of force from the movable insulator 13 to the fixing insulator 11, thereby preventing damage to the fixing insulator 11 during removal or in the case of unintentional force being applied. In the connector 100, the metal fittings 12 are locked with the fixing insulator 11 in a state of being disposed inside the fixing insulator 11, i.e., in a state of being not exposed on the fitting surface 31*b*, the fitting surface 32*b*, the fitting surface 33*b*, and the fitting surface 34*b* of the fixing insulator 11. Accordingly, in comparison with a case where the metal fittings 12 are disposed on the surface of the fixing insulator 11, damage to other connectors caused by metallic fittings is suppressed, or unevenness of the surface of the fixing insulator 11 is reduced. This allows the second connector 20 to smoothly slide on the surface of the fixing insulator 11 when the first connector 10 and the second connector 20 are fitted to each other, thereby making the second connector 20 easily inserted into the first connector 10. In this way, the connector 100 can reduce its size, prevent a decrease in strength, and improve fitting performance when the first connector 10 and the second connector 20 are fitted to each other.

In the connector 100 according to embodiments, the movable insulator 13 has the lock portion 43 and the lock portion 44, the width L1 of which is larger than the width L2 of the contact holding portion 41. Accordingly, even when the width L2 of the contact holding portion 41 is made smaller for downsizing, a reduction in strength of the movable insulator 13 can be prevented.

In the connector 100 according to embodiments, the entire surfaces of the fitting surface 31*b*, the fitting surface 32*b*, the fitting surface 33*b*, and the fitting surface 34*b* are exposed to the second connector 20. In the connector 100 according to embodiments, the fitting surface 31*b*, the fitting surface 32*b*, the fitting surface 33*b*, and the fitting surface 34*b* for guiding the second connector 20 are coplanar and flat surfaces in the fixing insulator 11. In the connector 100 according to embodiments, the fitting surface 31*b*, the fitting surface 32*b*, the fitting surface 33*b*, and the fitting surface 34*b* are flat and continuously formed on the whole circumference of the fixing insulator 11. Accordingly, even when an operator tries to fit the first connector 10 to the second connector 20 in a state of being shifted from the normal position, the second connector 20 can smoothly move on the fitting surface 31*b*, the fitting surface 32*b*, the fitting surface 33*b*, and 34*b*, and they are not damaged by metallic fittings or the like. This allows the second connector 20 to be easily and securely guided, thereby improving operational performance for fitting task.

In the connector 100 according to embodiments, the bottom surface portion 41*a* and the bottom surface portion 44*a* of the movable insulator 13 facing the substrate surface 101*a* have a shape in which the distance from the substrate surface 101*a* increases from the center to both ends in the width direction D2. Accordingly, even when the movable insulator 13 sways in the width direction D2, the bottom surface portion 41*a* and the bottom surface portion 44*a* can be prevented from being in contact with the substrate surface 101*a*.

The technical scope of the present invention is not limited to embodiments, and modifications may be appropriately made without departing from the scope of the present invention. The explanation given to embodiments takes an example in which, at a contact portion between the insulator support portion 12*b* and each of the lock portion 43 and the lock portion 44, the protrusion portion 12*d* is provided to the insulator support portion 12*b*. However, embodiments are not limited thereto. For example, the protrusion portion may be provided to each of the lock portion 43 and the lock portion 44. The protrusion portions may be provided to both the insulator support portions 12*b* and to the lock portion 43 and the lock portion 44.

The explanation given to embodiments takes an example in which the bottom surface portion 41*a*, the bottom surface portion 43*a*, and the bottom surface portion 44*a* of the movable insulator 13 each have a curved shape. However, embodiments are not limited thereto. The shape of the movable insulator 13 may be other shapes as long as the bottom surface portion 41*a*, the bottom surface portion 43*a*, and the bottom surface portion 44*a* are configured not to be in contact with the substrate surface 101*a* when the movable insulator 13 sways in the width direction D2. For example, the bottom surface portion 41*a*, the bottom surface portion 43*a*, and the bottom surface portion 44*a* may have a planar shape parallel to the virtual plane S (the substrate surface 101*a*) at the central part in the width direction D2, and have a curved shape partially at both ends in the width direction D2. For example, the bottom surface portion 41*a*, the bottom surface portion 43*a*, and the bottom surface portion 44*a* may have a planar shape (inclined plane), in which the distance from the substrate surface 101*a* increases from the center to both ends in the width direction D2. In this case, the inclined plane may be provided entirely from the center to both ends in the width direction D2, or the inclined plane may be provided partially at both ends in the width direction D2, while the central part in the width direction D2 has a planar shape parallel to the virtual plane S (the substrate surface 101*a*).

REFERENCE SIGNS LIST

D1 CONTACT ARRAY DIRECTION
D2 WIDTH DIRECTION
D3 FITTING DIRECTION
L1 WIDTH
L2 WIDTH
S VIRTUAL PLANE
10 FIRST CONNECTOR
11 FIXING INSULATOR
12, 22 METAL FITTING
12*a*, 22*a* MOUNTING PORTION
12*b* INSULATOR SUPPORT PORTION
12*c*, 22*b* INSULATOR LOCK PORTION
12*d* PROTRUSION PORTION
13 MOVABLE INSULATOR
14, 24 CONTACT
14*a* MOUNTING PORTION
14*b* FIRST LOCK PORTION
14*c* ELASTIC DEFORMATION PORTION
14*d* SECOND LOCK PORTION
14*e* THIRD LOCK PORTION
14*f* FIRST CONNECTION PORTION
14*g* SECOND CONNECTION PORTION
20 SECOND CONNECTOR
21 INSULATOR
24*a* MOUNTING PORTION
24*b* LOCK PORTION
24*c* FIRST CONNECTION PORTION
24*d* SECOND CONNECTION PORTION
31, 32 WALL PORTION
31*b*, 32*b*, 33*b*, 34*b* FITTING SURFACE
33, 34 BEAM PORTION
33*a*, 34*a* SUPPORT SURFACE
41, 51 CONTACT HOLDING PORTION
41*a*, 43*a*, 44*a* BOTTOM SURFACE PORTION
42 INSERT HOLE
43, 44 LOCK PORTION
52 OUTER INSERTION PORTION
53 INNER INSERTION PORTION
52*b*, 53*b* FITTING SURFACE
100 CONNECTOR
101 FIRST SUBSTRATE
102 SECOND SUBSTRATE
101*a*, 102*a* SUBSTRATE SURFACE

The invention claimed is:

1. A connector including a plurality of electrically conducting contacts and fitted to another connector, said connector comprising:

a fixing insulator having a frame shape;

a plurality of metal fittings that are disposed at both ends of said fixing insulator in a contact array direction in which said contacts are arrayed, and that are provided inside said fixing insulator; and a movable insulator that is disposed inside said fixing insulator, that is connected to said fixing insulator through elastic deformation portions of said contacts, and that is movable at least in a direction perpendicular to a fitting direction of said fitting to said other connector by elastic deformation of said elastic deformation portions, both ends of said movable insulator in said contact array direction, in which said contacts are arrayed, being disposed under and facing said respective metal fittings, wherein each of the plurality of metal fittings is disposed between said fixing insulator and said movable insulator in said fitting direction of said fitting to said other connector.

2. The connector according to claim 1, wherein said both ends of said movable insulator in said contact array direction, in which said contacts are arrayed, are formed to be wider than a central part of said movable insulator in a width direction orthogonal to said contact array direction, in which said contacts are arrayed, on a plane perpendicular to said fitting direction of said fitting to said other connector.

3. The connector according to claim 1, wherein both ends of said movable insulator in said contact array direction, in which said contacts are arrayed, are restricted by said metal fittings when removed from said other connector.

4. The connector according to claim 1, wherein said fixing insulator includes a fitting surface in said fitting direction of said fitting to said other connector, said fitting surface being formed of only said fixing insulator.

5. The connector according to claim 4, wherein said fitting surface is flat and provided in an identical plane.

6. The connector according to claim 4, wherein said fitting surface is flat and continuously formed on a whole circumference of said fixing insulator.

7. The connector according to claim 1, wherein a bottom surface of said movable insulator on an opposite side of a fitting surface side fitted to said other connector has a shape in which a distance from a virtual plane facing said bottom surface increases from a center to an end in a direction perpendicular to said fitting direction of said fitting to said other connector.

* * * * *